US005807002A

United States Patent [19]

Tsai

[11] Patent Number: 5,807,002

[45] Date of Patent: Sep. 15, 1998

[54] SUPER-THIN PLASTIC KEY

[75] Inventor: Jason Tsai, Taipei Hsien, Taiwan

[73] Assignee: Silitek Corporation

[21] Appl. No.: 917,489

[22] Filed: Aug. 26, 1997

[51] Int. Cl.[6] ..... B41J 5/12; H01H 9/18

[52] U.S. Cl. ..... 400/494; 400/490; 200/314; 200/317; 200/512; 200/311

[58] Field of Search ..... 400/494, 490, 400/491; 200/311, 512, 314, 317

[56] References Cited

U.S. PATENT DOCUMENTS

| | | | |
|---|---|---|---|
| 5,036,440 | 7/1991 | Takii et al. | 362/95 |
| 5,401,133 | 3/1995 | Moriike et al. | 200/341 |
| 5,477,430 | 12/1995 | LaRose | 200/314 |

FOREIGN PATENT DOCUMENTS

| | | | |
|---|---|---|---|
| 2-260334 | 10/1990 | Japan . | |
| 2-260335 | 10/1990 | Japan . | |
| 4-253119 | 9/1992 | Japan | 200/313 |

*Primary Examiner*—Edgar S. Burr
*Assistant Examiner*—Daniel J. Colilla
*Attorney, Agent, or Firm*—Rosenberg, Klein & Bilker

[57] ABSTRACT

The subject invention relates to a type of super-thin plastic key, comprising a top part and a base part; said top part comprising a top part foundation, a layer of light permeable ink and a layer of light-proof ink; using a plastic film as the top part foundation; on said top part foundation is printed a layer of light permeable ink; on said light permeable ink is printed a layer of light-proof ink to display a letter or figure; said top part foundation printed with the light permeable ink and the light-proof ink is subjected to hot-press process to form a top part with a specified shape; said top part and the base part are again subjected to an extrusion monobloc forming process, to form a light permeable super-thin plastic key; by said configuration to achieve the requirements of light weight, thin, short, and small size for electronic telecommunication products; thus avoiding the weakness of poor adhesion and achieving the purposes of simple production and reduced costs.

3 Claims, 3 Drawing Sheets

SUPER-THIN PLASTIC KEY

BACKGROUND OF THE INVENTION

The subject invention relates to a type of super-thin plastic key, particularly to one that can be applied to general electronic telecommunication products, mobile phones, PHS, BB-calls, and other equipment or machine operation.

DESCRIPTION OF PRIOR ART

Conventionally, a prior art of super-thin plastic key is made of a plastic film to form a top part; then, a plastic extrusion process to form a base part; the two parts are then adhered together before they are subjected to laser processing and printing to display a letter or figure, to form a thin-film key. Or, an alternative is to print on a plastic film which is then subjected to high-powered compression process to form a thin-film key. However, the production procedures of said conventional super-thin plastic key are quite sophisticated, so the production costs could not be reduced; besides, the adhesion between the top part and the base part is poor, so they would often fall apart; or, in case the alternative method of high pressure monobloc forming process is employed, it would require very high costs in the investment in vacuum high pressure forming equipment.

SUMMARY OF THE INVENTION

The primary purpose of the subject invention is to provide a type of super-thin plastic key, mainly comprising a PC or PET film as the material for the top part foundation of the key, before it is subjected to screen printing to display the letter or figure; then, it is subjected to hot-press mold to extrude a top part; and then, it is put in an extrusion mold, with the addition of PC, AS resin, ABS resin or silicone, to form a super-thin plastic key; the subject invention involves such features of simple production procedures, better adhesive force, the achievement of features of light weight, thin, short, small size and reduced costs, as well as no need of investing in vacuum high pressure forming equipment.

To enable better understanding of the characteristics and technical contents of the subject invention, please refer to the following detailed description with drawings; however, the attached drawings are only for the purposes of reference and description, which shall not be based to restrict or limit the subject invention: The drawings of the embodiment are:

BRIEF DESCRIPTION OF NUMERALS

Figure 1:
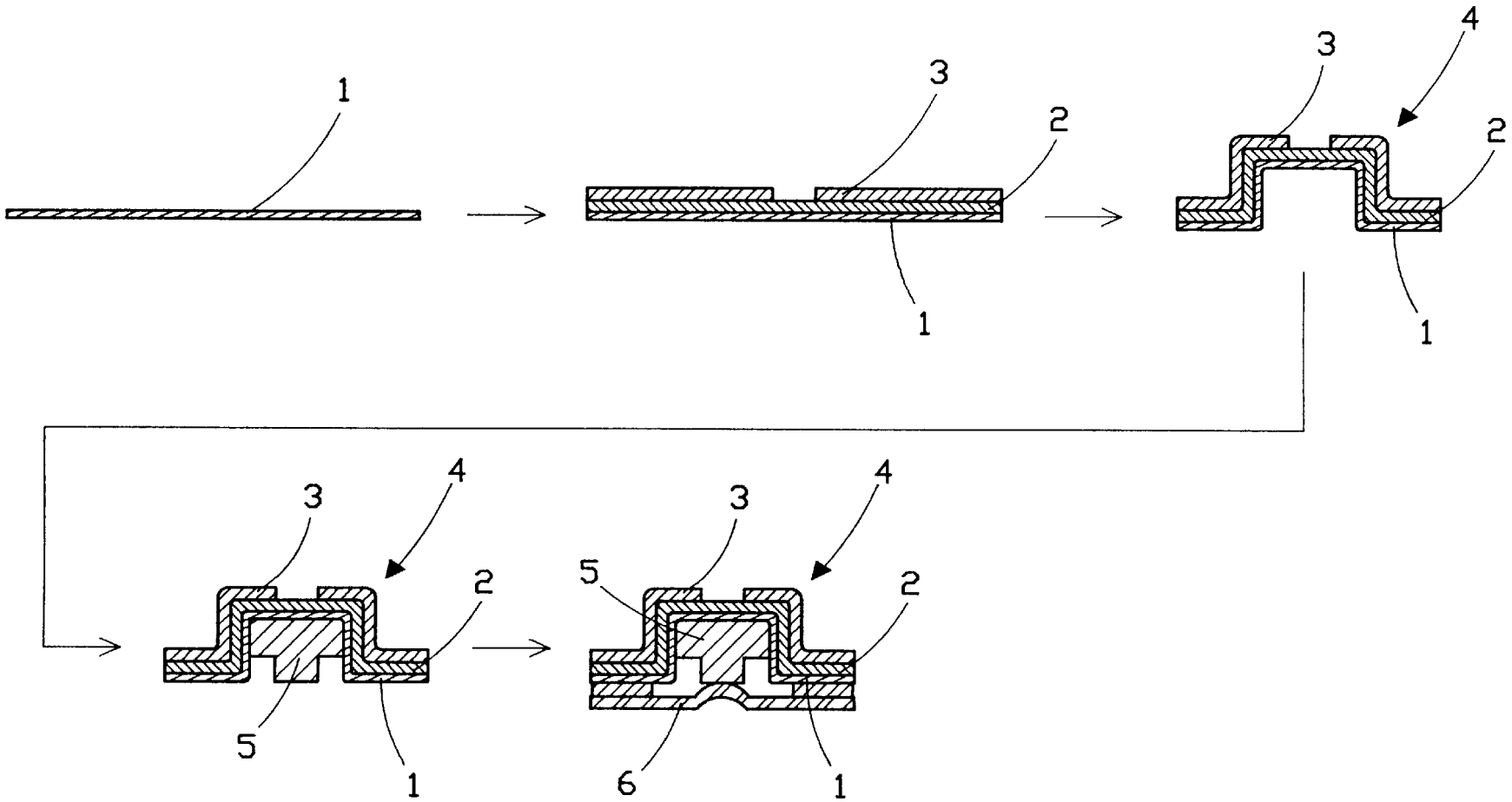
FIG. 1 is diagram of the production procedures of the subject invention.

1 top part foundation
2 light permeable ink
3 light-proof ink
4 top part
5 base part
6 push part

DETAILED DESCRIPTION OF PREFERRED EMBODIMENT

Figure 2:
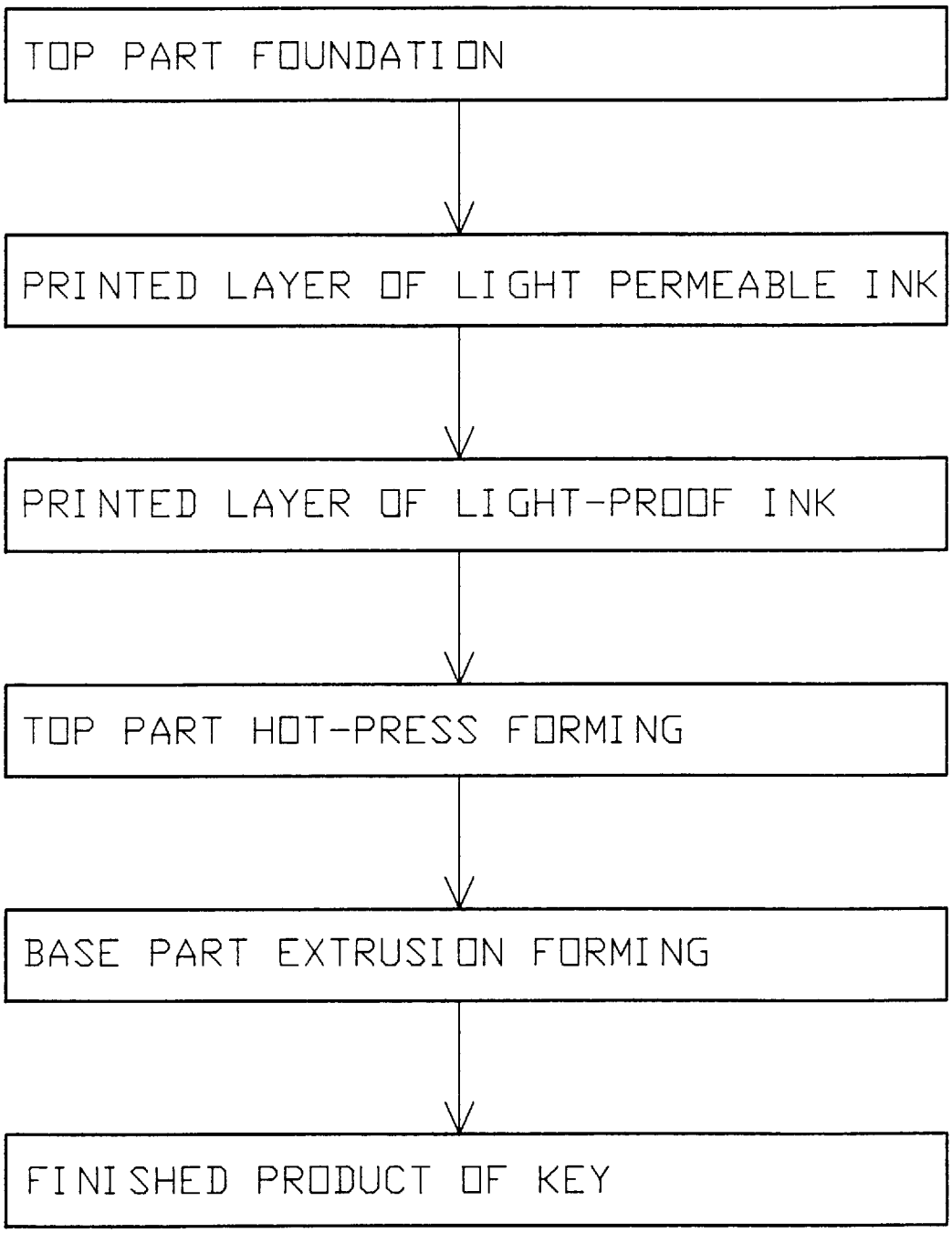
FIG. 2 is a production flow chart of the subject invention.

Please refer to FIGS. 1 and 2 which are respectively a diagram of the production procedures of the subject invention and a production flow chart of the subject invention. The subject invention of super-thin plastic key comprises a top part 4 and a base part 5; said top part 4 comprising a top part foundation 1, light permeable ink 2 and light-proof ink 3; wherein PC, PET or such thermoplastic film is used as the top part foundation 1; the thickness of said top part foundation 1 is 0.125–0.175 mm; then, a layer of light permeable ink 2 with the addition of Coupling Agent is coated onto the top part foundation 1; then, another layer of ink 3 with screen printing is printed onto the light permeable ink 2 to display the letter or figure; then, the top part foundation 1 printed with the light permeable ink 2 and the light-proof ink 3 is put to a hot-press forming process, and subjected to 100° C./2 min and extruded to form a specified shape of top part 4; then, said top part 4 is put into the extrusion forming machine, with the mixture of PC, AS resin, ABS resin or silicone, which are extruded to form a base part 5; so that the top part 4 and the base part are joined to form a super-thin plastic key that can be adhered to a push part 6.

Figure 3:
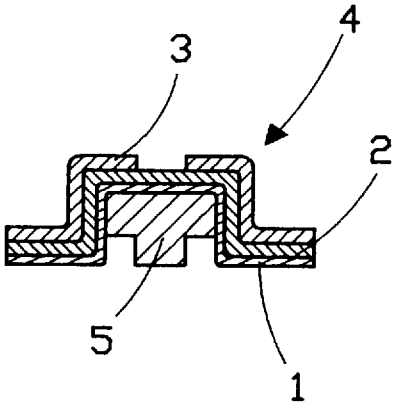
FIG. 3 is a cross-sectional view of the subject invention.

Referring to FIG. 3 which is a plain view of the subject invention. The subject invention of super-thin plastic key utilizes a plastic film as the top part foundation 1; on said top part foundation 1 is printed with a layer of light permeable ink 2; on said light permeable ink 2 is a layer of light-proof ink 3 to display a letter or figure; said top part foundation 1 is subjected to hot-press process to press a top part 4; said top part 4 and the base part 5 are subjected to extrusion process to form a light-permeable super-thin plastic key. The subject invention involves PC and PET materials to make a top part 4; thus achieving the requirements of light weight, thin, short and small size for telecommunication products; furthermore, the top part 4 and the base part 5 are subjected to the extruder to produce a monobloc formed product, thus avoiding the weakness of improper adhesion and falling off in a conventional adhering method; meanwhile, the production of the subject invention is simple enough to reduce the costs, so there is no need of investing in a vacuum hypertension forming equipment.

I claim:

1. A thin plastic key, comprising a top part and a base part; said top part comprising a top part foundation, a light permeable ink and a light-proof ink; said top part foundation being formed from a plastic film; a layer of said light permeable ink; a layer of said light-proof ink printed on said light permeable ink to form a letter or figure;

means forming said top part foundation printed with said layer of light permeable ink and said layer of light-proof ink to a specified shape by a hot-press process; said top part and base part being extruded in a monobloc forming process to form a thin plastic key.

2. The thin plastic key, as recited in claim 1, wherein the top part foundation is made of PC or PET material.

3. The thin plastic key, as recited in claim 1, wherein the base part is made of a material selected form the group consisting of: PC, AS resin, ABS resin or silicone material that is extrusion formed.

* * * * *